US010463575B2

(12) United States Patent
Mwanza

(10) Patent No.: US 10,463,575 B2
(45) Date of Patent: Nov. 5, 2019

(54) MEDICATION DISPENSING ASSEMBLY

(71) Applicant: Chinyimbiri Mwanza, Concord, NC (US)

(72) Inventor: Chinyimbiri Mwanza, Concord, NC (US)

( * ) Notice: Subject to any disclaimer, the term of this patent is extended or adjusted under 35 U.S.C. 154(b) by 0 days.

(21) Appl. No.: 15/908,241

(22) Filed: Feb. 28, 2018

(65) Prior Publication Data

US 2019/0262235 A1 Aug. 29, 2019

(51) Int. Cl.

| | |
|---|---|
| ***A61J 7/04*** | (2006.01) |
| ***B65D 83/04*** | (2006.01) |
| ***A61J 7/00*** | (2006.01) |
| *B65D 81/32* | (2006.01) |

(52) U.S. Cl.

CPC ..... *A61J 7/0481* (2013.01); *A61J 7/0015* (2013.01); *B65D 83/0445* (2013.01); *A61J 7/0427* (2015.05); *B65D 81/3205* (2013.01)

(58) Field of Classification Search

None

See application file for complete search history.

(56) References Cited

U.S. PATENT DOCUMENTS

| | | | | |
|---|---|---|---|---|
| 2,940,447 | A | 6/1960 | Zanegood | |
| 4,051,977 | A * | 10/1977 | Steinfeld | B65D 81/3216 206/216 |
| 4,135,512 | A | 1/1979 | Godsey | |
| 7,500,579 | B2 | 3/2009 | Crossley | |
| 9,144,933 | B2 | 9/2015 | Gillingwater | |
| 2002/0121454 | A1 | 9/2002 | Ross | |
| 2004/0074915 | A1* | 4/2004 | Hallin | B65D 83/0418 221/223 |
| 2012/0145726 | A1* | 6/2012 | Sae | A47G 19/2266 220/703 |
| 2015/0102041 | A1* | 4/2015 | Lee | A47G 19/30 220/575 |
| 2016/0107820 | A1* | 4/2016 | MacVittie | A61J 7/0472 221/13 |

* cited by examiner

*Primary Examiner* — Jacob S. Scott
*Assistant Examiner* — Ayodeji T Ojofeitimi

(57) ABSTRACT

A medication dispensing assembly includes a container that has a plurality of reservoirs therein for containing pills and a liquid. A pill dispenser is coupled to the container and the pill dispenser is aligned with an associated one of the reservoirs to releases the pills from the container. A liquid dispenser is coupled to the container and the liquid dispenser is aligned with an associated one of the reservoirs to selectively release the liquid from the second reservoir. Alert unit is coupled to the container and the alert unit emits a reminder comprising an audible sounds. In this way the alert unit reminds a user to take the pills and the liquid at predetermined times.

10 Claims, 5 Drawing Sheets

MEDICATION DISPENSING ASSEMBLY

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

(2) Description of Related Art Including Information Disclosed Under 37 CFR 1.97 and 1.98

The disclosure and prior art relates to dispensing devices and more particularly pertains to a new dispensing device for reminding a user to dispense a selected amount of a medication at predetermined times.

BRIEF SUMMARY OF THE INVENTION

An embodiment of the disclosure meets the needs presented above by generally comprising a container that has a plurality of reservoirs therein for containing pills and a liquid. A pill dispenser is coupled to the container and the pill dispenser is aligned with an associated one of the reservoirs to releases the pills from the container. A liquid dispenser is coupled to the container and the liquid dispenser is aligned with an associated one of the reservoirs to selectively release the liquid from the second reservoir. Alert unit is coupled to the container and the alert unit emits a reminder comprising an audible sounds. In this way the alert unit reminds a user to take the pills and the liquid at predetermined times.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
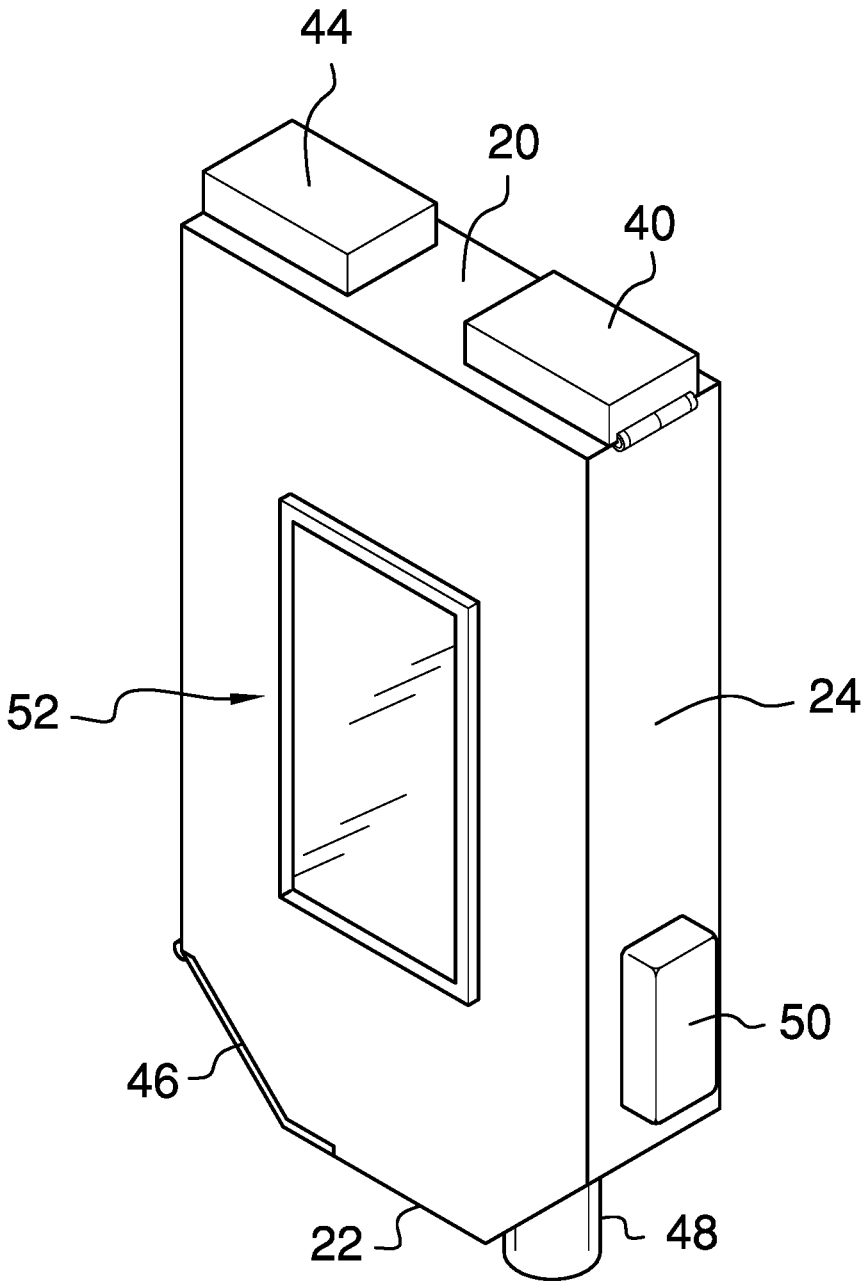
FIG. 1 is a front perspective view of a medication dispensing assembly according to an embodiment of the disclosure.
Figure 2:
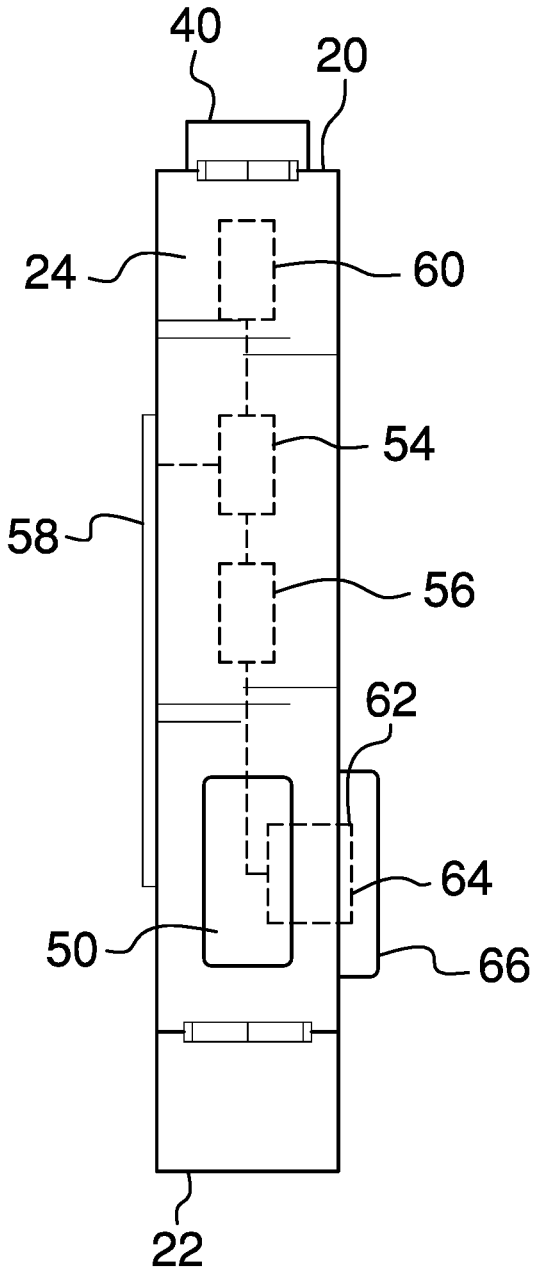
FIG. 2 is a left side phantom view of an embodiment of the disclosure.
Figure 3:
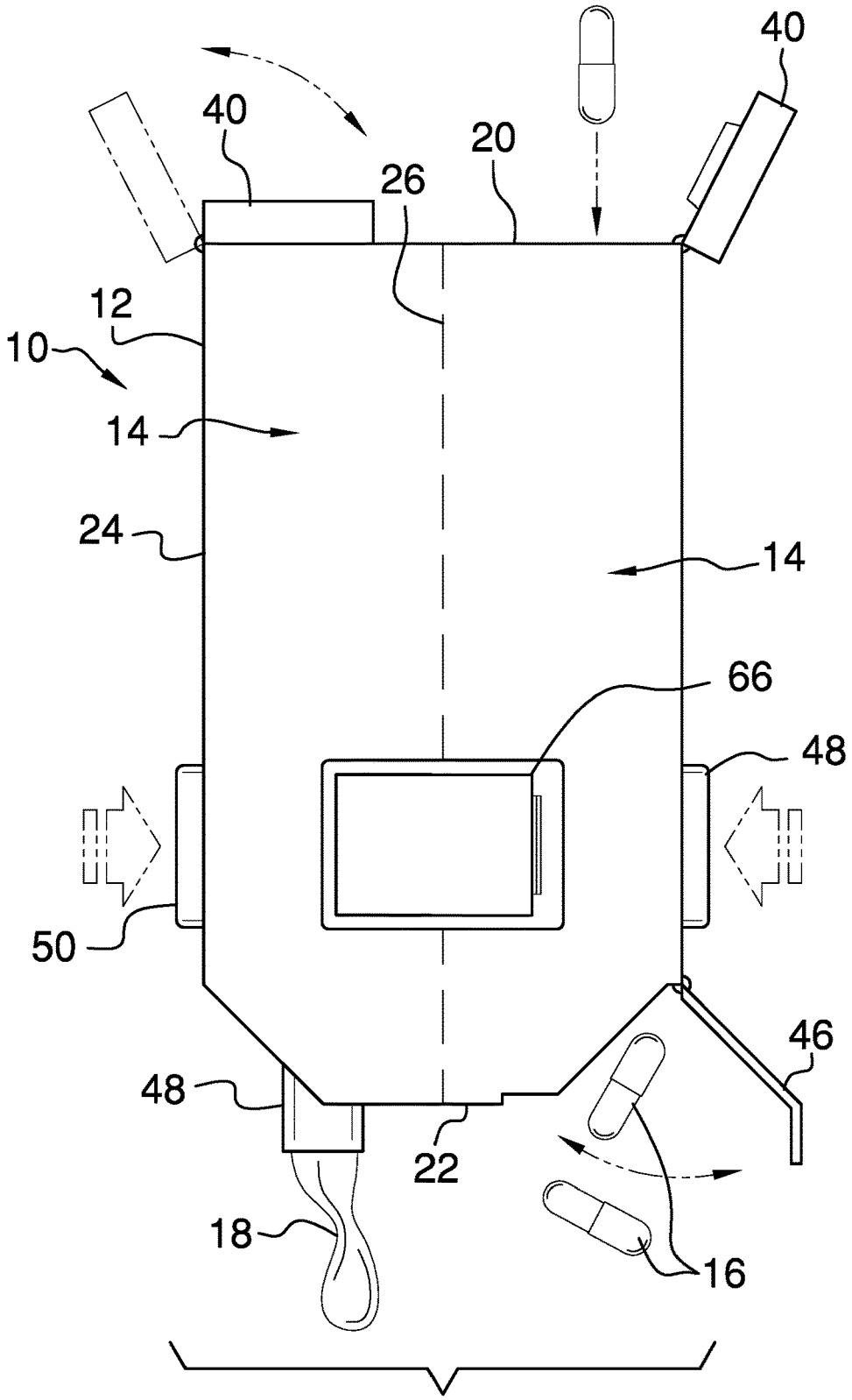
FIG. 3 is a perspective in-use view of an embodiment of the disclosure.
Figure 4:
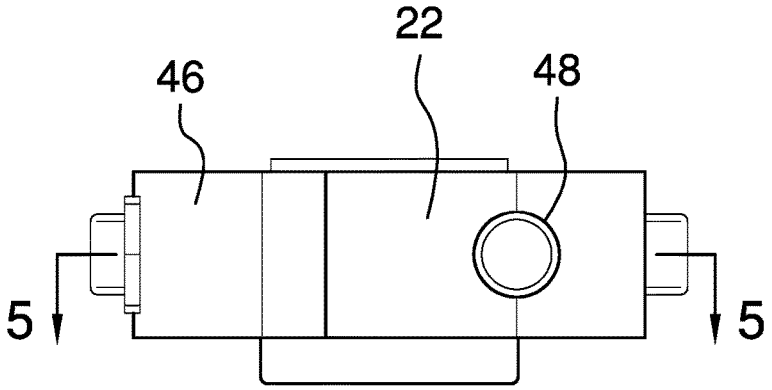
FIG. 4 is a bottom view of an embodiment of the disclosure.
Figure 5:
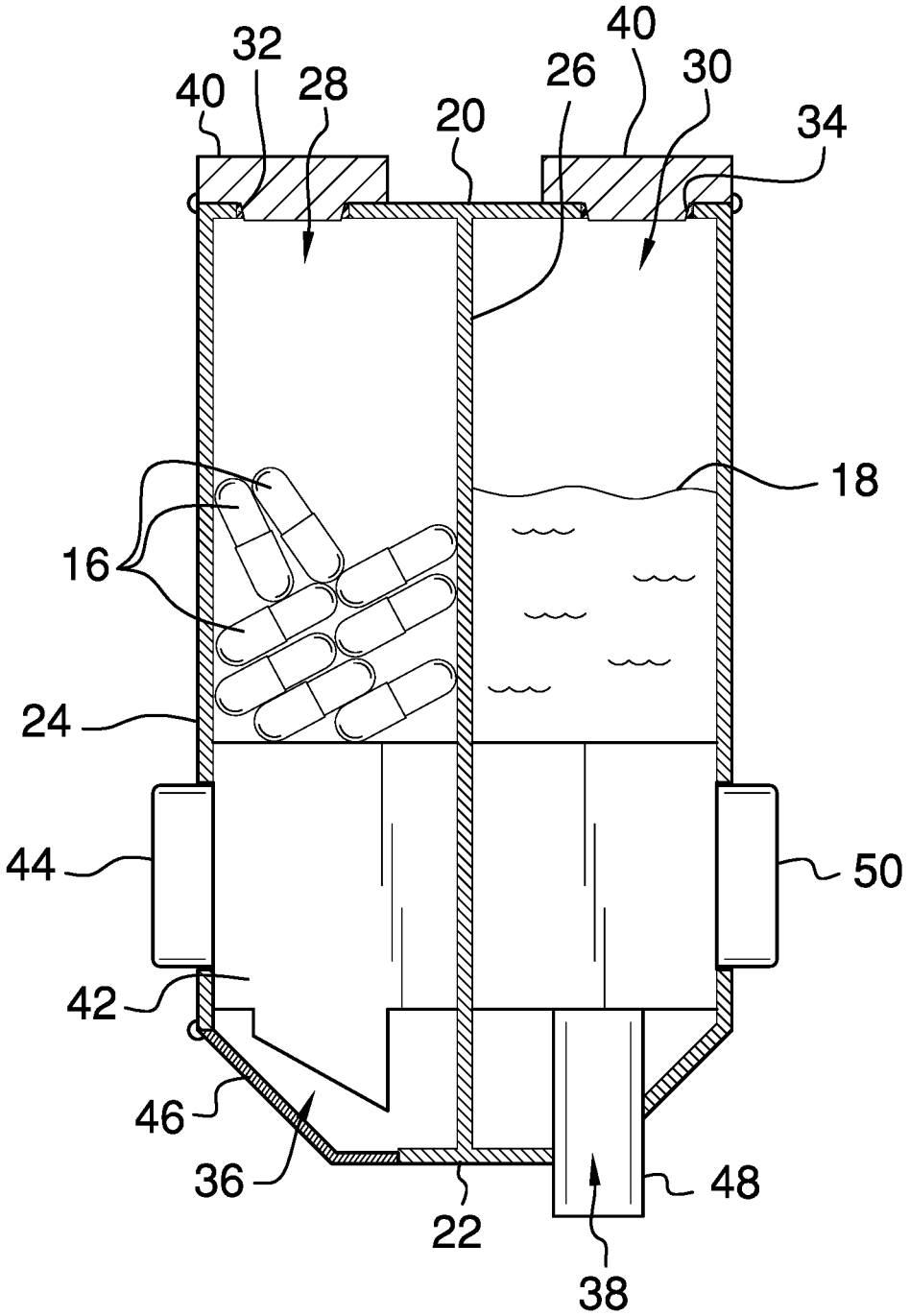
FIG. 5 is a cross sectional view taken along line 5-5 of FIG. 4 of an embodiment of the disclosure.

With reference now to the drawings, and in particular to FIGS. 1 through 5 thereof, a new dispensing device embodying the principles and concepts of an embodiment of the disclosure and generally designated by the reference numeral 10 will be described.

As best illustrated in FIGS. 1 through 5, the medication dispensing assembly 10 generally comprises a container 12 that has a plurality of reservoirs 14 therein. One of the reservoirs 14 contain pills 16, such as prescription medication or the like, and one of the reservoirs 14 contains a liquid 18, such as a liquid medication or the like. The container 12 has a top wall 20, a bottom wall 22 and an outer wall 24 extending therebetween. The container 12 has a divider 26 extending between the top wall 20 and the bottom wall 22 to define a first one of the reservoirs 28 and a second one of the reservoirs 30.

The top wall 20 has a first aperture 32 extending into the first reservoir 28 for filling the first reservoir 28 with pills 16. The top wall 20 has a second aperture 34 extending into the second reservoir 30 for refilling the second reservoir 30 with the liquid 18. The bottom wall 22 has a first opening 36 extending into the first reservoir 28 for releasing the pills 16. The bottom wall 22 has a second opening 38 extending into the second reservoir 30 for releasing the liquid 18. A pair of lids 40 is provided and each of the lids 40 is hingedly coupled to the top wall 20 of the container 12. Each of the lids 40 is aligned with an associated one of the first aperture 32 and the second aperture 34 to close the first aperture 32 and the second aperture 34.

A pill dispenser 42 is provided and the pill container 12 is slidably coupled to the container 12. The pill dispenser 42 is aligned the first reservoir 28 such that the pill dispenser 42 selectively releases the pills 16 from the container 12. The pill dispenser 42 is biased into a closed condition to inhibit the pills 16 from exiting the container 12. Moreover, the pill dispenser 42 is urged into a second condition to facilitate the pills 16 to exit through the first opening 36 in the bottom wall 22 of the container 12.

The pill dispenser 42 has a first button 44 extending outwardly through the outer wall 24 of the container 12 for urging the pill dispenser 42 into the second condition. The pill dispenser 42 may be a mechanical pill dispenser 42 of any conventional design. A door 46 is provided and the door 46 is hingedly coupled to the bottom wall of the container. The door 46 is aligned with the first opening 36 and door 46 is biased to close the first opening 36. The pill dispenser 42 engages the door 46 when the pill dispenser 42 is urged into the second condition thereby opening the door 46.

A liquid 18 dispenser is provided and the liquid 18 dispenser is coupled to the container 12. The liquid 18 dispenser is aligned with the second reservoir 30 such that the liquid 18 dispenser selectively releases from the second reservoir 30. The liquid 18 dispenser is biased into a closed condition to inhibit the liquid 18 from exiting the container 12. Additionally, the liquid 18 dispenser is urged into a second condition to facilitate the liquid 18 to exit through the second opening 38 in the bottom wall 22 of the container 12. The liquid 18 dispenser has a spout 48 extending outwardly through the second opening 38 to direct the liquid 18 into a user's mouth. Moreover, the liquid 18 dispenser has a second button 50 extending outwardly through the outer wall 24 of the container 12 for urging the liquid 18 dispenser into the second condition. The liquid 18 dispenser may be a mechanical liquid 18 dispenser of any conventional design.

An alert unit 52 is coupled to the container 12 to emit a reminder comprising an audible sound. In this way the alert unit 52 may remind the user to take the pills 16 and the liquid 18 at predetermined times. The alert unit 52 comprises a control circuit 54 that is coupled to the container 12. An electronic timer 56 is coupled to the container 12 and the electronic timer 56 is electrically coupled to the control circuit 54.

A control 58 is provided and the control 58 is coupled to the container 12. The control 58 is electrically coupled to the control circuit 54 to program a reminder time into the electronic timer 56. The control 58 may comprise a touch screen or any other electronic control. A speaker 60 is coupled to the container 12 configured to emit audible sounds outwardly therefrom. The speaker 60 is electrically coupled to the control circuit 54 and the speaker 60 emits the audible sound to coincide with the reminder time. A power supply 62 is positioned within the container 12 and the power supply 62 is electrically coupled the control circuit 54. The power supply 62 comprises at least one battery 64. A battery cover 66 is removably coupled to the container 12 and the power supply 62 is positioned beneath the battery cover 66.

In use, the first reservoir 28 is filled with a selected number of the pills 16 and the second reservoir 30 is filled with a selected amount of the liquid 18. The control 58 is manipulated to program the reminder time into the electronic timer 56. The speaker 60 emits the audible sound at the reminder time to remind the user to take the pills 16 and liquid 18. The pill dispenser 42 is manipulated to dispense a selected number of the pills 16. The liquid 18 dispenser is manipulated to dispense a selected amount of the liquid 18. In this way the user is assisted with adhering to a medication schedule.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A medication dispensing assembly being configured to simultaneously release a pill and a liquid, said assembly comprising:

a container having a plurality of reservoirs therein, one of said reservoirs being configured to contain pills, one of said reservoirs being configured to contain a liquid, said container having a top wall, a bottom wall and an outer wall extending therebetween, said container having a divider extending between said top wall and said bottom wall to define a first one of said reservoirs and a second one of said reservoirs, said top wall having a first aperture extending into said first reservoir for filling said first reservoir with pills, said top wall having a second aperture extending into said second reservoir for refilling said second reservoir with the liquid, said bottom wall having a first opening extending into said first reservoir for releasing said pills;

a pill dispenser being coupled to said container, said pill dispenser being aligned with an associated one of said reservoirs such that said pill dispenser selectively releases the pills from said container, said pill dispenser being biased into a closed condition to inhibit the pills from exiting said container, said pill dispenser being urged into a second condition to facilitate the pills to exit through said first opening in said bottom wall of said container, said pill dispenser having a first button extending outwardly through said outer wall of said container wherein said first button is configured to be manipulated to urge said pill dispenser into said second condition;

a liquid dispenser being coupled to said container, said liquid dispenser being aligned with an associated one of said reservoirs such that said liquid dispenser selectively releases the liquid from said container; and an alert unit being coupled to said container wherein said alert unit is configured to emit a reminder comprising an audible sound to remind a user to take the pills and the liquid at predetermined times.

2. The assembly according to claim 1, wherein said bottom wall has a second opening extending into said second reservoir for releasing said liquid.

3. The assembly according to claim 1, further comprising a pair of lids, each of said lids being hingedly coupled to said top wall of said container, each of said lids being aligned with an associated one of said first aperture and said second aperture to close said first aperture and said second aperture.

4. The assembly according to claim 1, wherein said alert unit comprises a control circuit being coupled to said container.

5. The assembly according to claim 4, further comprising an electronic timer being coupled to said container, said electronic timer being electrically coupled to said control circuit.

6. The assembly according to claim 4, further comprising a speaker being coupled to said container wherein said speaker is configured to emit audible sounds outwardly therefrom, said speaker being electrically coupled to said control circuit, said speaker emitting the audible sound to coincide with the reminder time.

7. The assembly according to claim 4, further comprising a power supply being positioned within said container, said power supply being electrically coupled said control circuit, said power supply comprising at least one battery.

8. The assembly according to claim 5, further comprising a control, each of said control being movably coupled to said container, each of said control being electrically coupled to said control circuit to program a reminder time into said electronic timer.

9. A medication dispensing assembly being configured to simultaneously release a pill and a liquid, said assembly comprising:

a container having a plurality of reservoirs therein, one of said reservoirs being configured to contain pills, one of said reservoirs being configured to contain a liquid, said container having a top wall, a bottom wall and an outer wall extending therebetween, said container having a divider extending between said top wall and said bottom wall to define a first one of said reservoirs and a second one of said reservoirs, said top wall having a first aperture extending into said first reservoir for filling said first reservoir with pills, said top wall having a second aperture extending into said second reservoir for refilling said second reservoir with the liquid, said bottom wall having a first opening extending into said first reservoir for releasing said pills;

a pill dispenser being coupled to said container, said pill dispenser being aligned with an associated one of said reservoirs such that said pill dispenser selectively releases the pills from said container;

a liquid dispenser being coupled to said container, said liquid dispenser being aligned with an associated one of said reservoirs such that said liquid dispenser selectively releases the liquid from said container, said liquid dispenser being biased into a closed condition to inhibit the liquid from exiting said container, said liquid dispenser being urged into a second condition to facilitate the liquid to exit through said second opening in said bottom wall of said container, said liquid dispenser having a spout extending outwardly through said second opening to direct the liquid into a user's mouth, said liquid dispenser having a second button extending outwardly through said outer wall of said container wherein said second button is configured to be manipulated to urge said liquid dispenser into said second condition; and an alert unit being coupled to said container wherein said alert unit is configured to emit a reminder comprising an audible sound to remind a user to take the pills and the liquid at predetermined times.

10. A medication dispensing assembly being configured to simultaneously release a pill and a liquid, said assembly comprising:

a container having a plurality of reservoirs therein, one of said reservoirs being configured to contain pills, one of said reservoirs being configured to contain a liquid, said container having a top wall, a bottom wall and an outer wall extending therebetween, container having a divider extending between said top wall and said bottom wall to define a first one of said reservoirs and a second one of said reservoirs, said top wall having a first aperture extending into said first reservoir for filling said first reservoir with pills, said top wall having a second aperture extending into said second reservoir for refilling said second reservoir with the liquid, said bottom wall having a first opening extending into said first reservoir for releasing said pills, said bottom wall having a second opening extending into said second reservoir for releasing said liquid;

a pair of lids, each of said lids being hingedly coupled to said top wall of said container, each of said lids being aligned with an associated one of said first aperture and said second aperture to close said first aperture and said second aperture;

a pill dispenser being coupled to said container, said pill dispenser being aligned with an associated one of said reservoirs such that said pill dispenser selectively releases the pills from said container, said pill dispenser being biased into a closed condition to inhibit the pills from exiting said container, said pill dispenser being urged into a second condition to facilitate the pills to exit through said first opening in said bottom wall of said container, said pill dispenser having a first button extending outwardly through said outer wall of said container wherein said first button is configured to be manipulated to urge said pill dispenser into said second condition;

a liquid dispenser being coupled to said container, said liquid dispenser being aligned with an associated one of said reservoirs such that said liquid dispenser selectively releases the liquid from said container, said liquid dispenser being biased into a closed condition to inhibit the liquid from exiting said container, said liquid dispenser being urged into a second condition to facilitate the liquid to exit through said second opening in said bottom wall of said container, said liquid dispenser having a spout extending outwardly through said second opening to direct the liquid into a user's mouth, said liquid dispenser having a second button extending outwardly through said outer wall of said container wherein said second button is configured to be manipulated to urge said liquid dispenser into said second condition; and an alert unit being coupled to said container wherein said alert unit is configured to emit a reminder comprising an audible sound to remind the user to take the pills and the liquid at predetermined times, said alert unit comprising:

a control circuit being coupled to said container;

an electronic timer being coupled to said container, said electronic timer being electrically coupled to said control circuit;

a control, each of said control being movably coupled to said container, each of said control being electrically coupled to said control circuit to program a reminder time into said electronic timer;

a speaker being coupled to said container wherein said speaker is configured to emit audible sounds outwardly therefrom, said speaker being electrically coupled to said control circuit, said speaker emitting the audible sound to coincide with the reminder time; and a power supply being positioned within said container, said power supply being electrically coupled said control circuit, said power supply comprising at least one battery.

* * * * *